US006902248B2

(12) United States Patent
Koguchi

(10) Patent No.: US 6,902,248 B2
(45) Date of Patent: Jun. 7, 2005

(54) INKJET RECORDING METHOD

(75) Inventor: Hideyuki Koguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/436,441

(22) Filed: May 13, 2003

(65) Prior Publication Data

US 2004/0017424 A1 Jan. 29, 2004

(30) Foreign Application Priority Data

May 13, 2002 (JP) ..... 2002-136588

(51) Int. Cl.[7] ..... B41J 29/38
(52) U.S. Cl. ..... 347/12; 347/2; 347/107
(58) Field of Search ..... 347/12, 2, 107, 347/14, 19, 105, 106

(56) References Cited

U.S. PATENT DOCUMENTS 6,065,822 A * 5/2000 Sarraf ..... 347/15
6,158,844 A 12/2000 Murakami et al.
6,386,667 B1 * 5/2002 Cariffe ..... 347/12

FOREIGN PATENT DOCUMENTS

JP 05-238005 A 9/1993
JP 10-230607 A 9/1998

OTHER PUBLICATIONS

Ichinose et al., "Solidstate Scanning Ink Jet Recording with Slit Type Head", Institute of Electronics and Communication Engineers of Japan '83/1 vol. J 66–C, No. 1, pp. 47–54.

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

An inkjet recording method uses a line-array inkjet head, sets different ink ejection frequencies for respective ink ejection holes desposed in array and ejects ink onto a plate-shaped recording medium at the different ink ejection frequencies from the ink ejection holes to perform recording.

12 Claims, 6 Drawing Sheets

INKJET RECORDING METHOD

BACKGROUND OF THE INVENTION

1. Field of the Invention

The present invention relates to an inkjet recording method, and more particularly to an inkjet recording method capable of recording in a circular shape and simultaneously recording on areas with different resolutions by use of a line-array inkjet head.

2. Description of the Related Art

Printing a label for displaying a content of record, a title, etc. on the surface of a disk-shaped information recording medium (which will hereinafter be simply called a disk) such as a CD (compact disk) or a DVD (digital versatile disk) has hitherto involved creating a printing plate based on a design for printing and performing the printing within a series of manufacturing processes. In this case, a method of printing the label for display on the surface of the disk is classified into a method of printing the label directly on the surface of the disk and a method of temporarily printing the label on a seal different from the disk and pasting this label-printed seal onto the surface of the disk.

Further, the printing method has involved utilizing mainly screen printing, offset printing, thermal recording (melt thermal transfer and sublimation thermal transfer) or an electrophotography, or the like.

Further, with advancements of the technologies and a spread of the personal computers over the recent years, a multiplicity of disks in which information can be written, such as a CD-R and a CD-RW come to be utilized. Namely, those disks are utilized for publishing software components on a small scale or for a personal use such as writing the information by a PC user by himself or herself for the reasons of being inexpensive, easy to handle and large in recording capacity.

The mass-print oriented screen printing and offset printing described above are not suited to high-mix low-volume printing applications in which a content of the label to be printed differs for each group including a few sheets or every single sheet as in the case of the label printing for the CD-R, or the like.

Moreover, the thermal recording described above might cause transformation of the disk due to a decline of image quality and the heat applied when printed. The electrophotography likewise has problems both in the image quality and in the heat when fixed, and is therefore unpreferable to the label printing of the disk.

By contrast, the inkjet recording method is a method of jetting ink particles onto a recording target medium. The inkjet recording method has no problem about the transformation of the disk explained above because there occurs no contact with the recording medium when printing, and thus, the costs for printing are made lower with the much higher image quality.

JP5-238005 A discloses a technology of printing the label on the disk by use of the inkjet method described above.

This technology is that the disk is rotated at a predetermined rotational frequency and an inkjet device disposed facing a label printing surface of the rotating disk is used to print print data such as print target characters and pictures on the label printing surface of the disk, so that the labels with their designs different for every single sheet can be printed.

In the case of rotating the disk and printing by the inkjet head disposed facing the rotating surface of the disk, however, there arises a problem in that a peripheral speed differs between an inner peripheral side and an outer peripheral side of the rotating disk, and hence there occurs a difference in dot density of the ink recorded (transferred) between the inner peripheral side and the outer peripheral side if ejecting the ink with a fixed ink dot size at a fixed ink ejection frequency, resulting in unevenness in image density and a decline of image quality.

Accordingly, upon recording in the circular shape on the rotating disk by use of the inkjet recording method, it is required that the ink ejection frequency or the dot size of the ink ejected be so controlled as to be changed in accordance with the peripheral speed of the disk. The technology disclosed in JP 5-238005 A does not particularly include such a control scheme, with the result that the unevenness in image density might occur.

SUMMARY OF THE INVENTION

It is an object of the present invention, which has been devised in view of the problems inherent in the prior arts described above, to provide an inkjet recording method capable of easily recording characters and images on a disk in a circular shape with a high image quality and simultaneously recording on a plurality of areas with different resolutions.

In order to solve the above-mentioned problem, according to the present invention, there is provided an inkjet recording method using a line-array inkjet head, including:

setting ink ejection frequencies different for respective ink ejection holes disposed in array; and ejecting inks onto a plate-shaped recording medium at the different ink ejection frequencies from the ink ejection holes to perform recording.

Also, it is preferable that the line-array inkjet head and the recording medium are relatively rotated about a straight line, as an axis of rotation, passing through one point on a straight line extending inclusively of the line-array, which is perpendicular to the recording medium, and the recording is performed by ejecting an ink from each of the ink ejection holes at the ink ejection frequency substantially proportional to a relative peripheral rotating speed in a position of each of the ink ejection holes.

Also, it is preferable that when performing the recording by ejecting the ink from each of the ink ejection holes, a recording dot size differs for each of the ink ejection holes.

Also, it is preferable that the recording dot size is substantially proportional to the relative peripheral rotating speed in the position of each of the ink ejection holes.

It is preferable that a pitch between the adjacent ink ejection holes among the ink ejection holes is substantially inversely proportional to a distance from the center of relative rotations.

It is preferable that an ink ejection frequency at which the ink is ejected from each of the ink ejection holes is finely adjusted so that degrees of superposition of recording dots of the ink ejected onto a recording medium from the respective ink ejection holes are substantially uniform on the recording medium.

Further, it is preferable that the ink ejection frequency at which the ink is ejected from each of the ink ejection holes is changed in accordance with a content of the recording.

DETAILED DESCRIPTION OF THE PREFERRED EMBODIMENTS

Preferred embodiments of an inkjet recording method according to the present invention will hereinafter be described in detail with reference to accompanying drawings.

Figure 1:
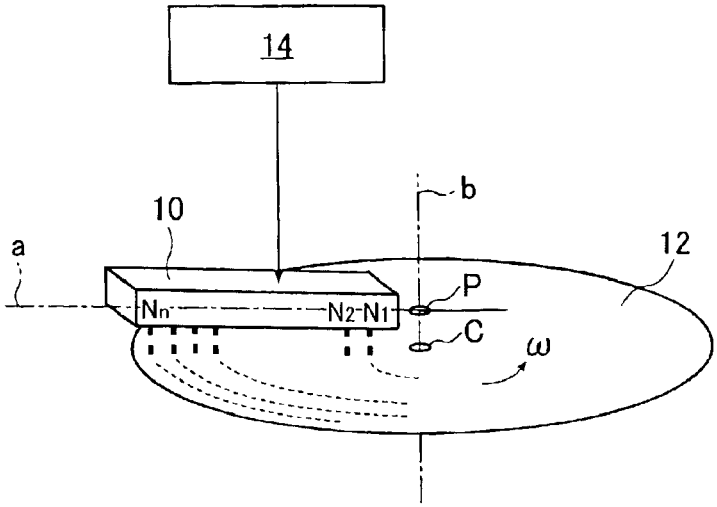
FIG. 1 is a schematic perspective view showing one example of a configuration of a device including a line-array inkjet head in accordance with a first embodiment of an inkjet recording method of the present invention.

FIG. 1 is a schematic perspective view showing one example of configuration of a device including a line-array inkjet head in accordance with a first embodiment of the inkjet recording method of the present invention.

As illustrated in FIG. 1, the device for carrying out the inject recording method in the first embodiment is constructed of a line-array inkjet head 10 (which will hereinafter simply be referred to as the inkjet head 10), a disk 12 such as a CD, and an inkjet drive control unit 14 for controlling the inkjet head 10.

This device is designed to record (print) a label containing images, characters, etc. in a circular shape in a way that the inkjet head 10 and the disk 12 relatively rotate and an ink is ejected onto a surface of the disk 12 out of the inkjet head 10. On this occasion, the label is recorded (printed) while (relatively) rotating the inkjet head 10 and the disk 12, and therefore the inkjet drive control unit 14 controls an ink ejection frequency in accordance with a peripheral speed so as not to cause an unevenness in image density because of a difference in peripheral speed between an inner peripheral side and an outer peripheral side of rotations.

As for the relative rotations described above, any one of the inkjet head 10 and the disk 12 may be rotated, but the device configuration and the control become simpler by rotating the disk 12 than the inkjet head 10, and hence the disk 12 is preferably rotated. The disk 12 is rotated at a rotating speed based on inkjet recording unlike the rotations in the normal case of recording and reading information on and from the disk 12.

In contrast with the case of rotating the disk 12, the inkjet head 10, if rotated, may be rotated about a straight line b as an axis of rotation, the line b being perpendicular to the disk 12 and passing through a predetermined point P (that is, e.g., a point from which the line supposedly extends vertically down to the disk 12 and reaches the disk 12 at the center C) existing on a straight line a extending inclusively of an entire length of the inkjet head 10.

In the case of rotating the inkjet head 10, however, it is difficult to design a layout of an ink supply path and connecting portions of electric wirings etc. for the control. It is therefore preferable to rotate the disk 12 as described above and, according to the first embodiment, the disk 12 is rotated about the center C.

The disk 12 is, with its surface on which a label is printed being set upward, rotated by an unillustrated motor about the center C at a rotational frequency for recording by the inkjet head 10.

The inkjet head 10 is configured such that a plurality of (n) nozzles (ink ejection holes) N1 through Nn for ejecting inks are arrayed in line from the side of the center C of the disk 12 toward an outer peripheral side thereof while facing these nozzles to the surface of the disk 12. The ink ejection is not performed while being limited to a specified method and may take any methods.

As discussed above, in the case where the label is printed on the surface of the rotating disk 12 by the, inkjet head 10, the peripheral speed differs between the inner peripheral side and the outer peripheral side of the disk 12, and therefore, if printed at a fixed ink ejection frequency, a recording dot density on the outer peripheral side becomes lower than on the inner peripheral side, resulting in an occurrence of unevenness in image density. As a countermeasure therefor, the ink ejection frequency must be changed in accordance with the peripheral speed (a relative peripheral rotating speed) between the nozzles (N1-side) for printing on the inner peripheral side of the disk 12 and the nozzles (Nn-side) for printing on the outer peripheral side thereof. For example, the peripheral speeds in positions corresponding to the respective nozzles N1, . . . , Nn are respectively expressed as follows:

$$V1=\omega\cdot R1, \ldots, Vn=\omega\cdot Rn$$

where ω is an angular speed of the disk 12, and R1, . . . , Rn are distances from the center C of rotations to the positions corresponding to the respective nozzles N1, . . . , Nn on the disk 12.

Further, provided that the ink ejection frequencies from the respective nozzles N1, . . . , Nn are respectively represented by f1, . . . , fn, the ink ejection frequencies are set different from each other as follows: f1≠f2≠ . . . ≠fn.

To be specific, the ink ejection frequency is set substantially proportional to the peripheral speed of the disk 12 in the position of the nozzle Ni so that the ink ejection frequency becomes lower on the inner peripheral side and higher on the outer peripheral side. Now that the angular speed ω of the disk 12 is fixed, a condition proportional to the peripheral speed is the same as that proportional to the distance from the center (which is a radius of rotation in a position of the nozzle). Namely, to formulate it, there may be given fi=α·Ri, where α is a predetermined constant. This formula leads to f1<f2< . . . <fn, so that the ink ejection frequency becomes higher as the nozzle position gets closer to the outer periphery.

For preventing the unevenness in image density of the inks between the inner peripheral side and the outer peripheral side of the rotations, in place of or in addition to change of the ink ejection frequency in the way explained above, a dot size (a recording dot size) of the ink ejected from each of the nozzles N1, . . . , Nn may be changed.

The dot sizes of the inks ejected form the nozzles N1, . . . , Nn are set to d1, . . . , dn, respectively. In this case, the dot sizes d1, . . . , dn are changed in accordance with the peripheral speed. Namely, a relationship between the dot sizes is basically set to meet the following relationship: d1≠d2≠ . . . ≠dn. However, to be specific, this relationship is set to meet the relationship: d1<d2< . . . <dn, such that the dot size becomes larger on the outer peripheral side than on the inner peripheral side.

Further, at this time, while adjusting degrees to which the dots are superposed on each other, the dot sizes d1, . . . , dn may be set to d1', . . . , dn'. However, the dot sizes are set to meet the relationship: di<di', and may be set as follows: d1'< . . . <dn'.

The inkjet drive control unit 14 controls the inkjet ejection frequency or the dot sizes. For instance, gradation printing can be attained while changing the dot sizes of the inks ejected from the inkjet head 10 by controlling them based on pulse width modulation (PWM).

Figure 2A:
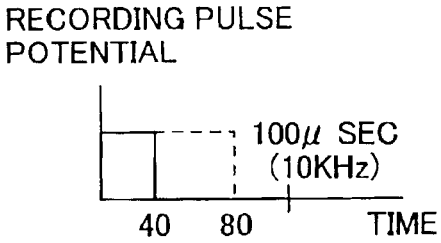
FIG. 2A is an explanatory diagram of a pulse width modulation for changing a recording dot size, showing an output pulse width.
Figure 2B:
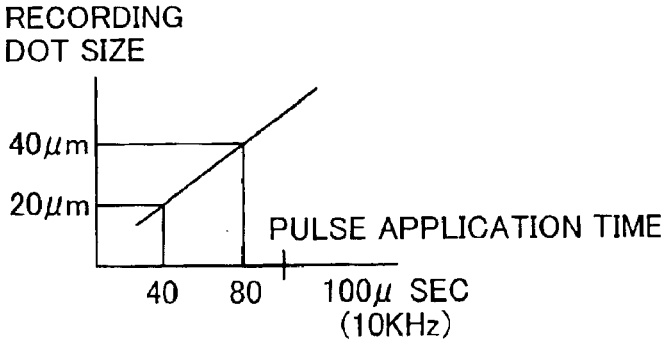
FIG. 2B is an explanatory diagram of the pulse width modulation, showing a relationship between each output pulse width and the recording dot size.

FIG. 2A shows an output pulse width. FIG. 2B shows a relationship between the recording dot sizes and the output pulse widths.

For example, when the ink ejection frequency is 10 kHz and a duty ratio is 40%, a pulse application time is 40 μsec. At this time, the recording dot size is 20 μm. Supposing that the ink ejection frequency is 10 kHz and the duty ratio is 80%, however, the pulse application time becomes 80 μsec, and the recording dot size becomes 40 μm. Thus, the recording dot size can be controlled based on the pulse width modulation.

Note that as to the pulse application time in FIG. 2A, a relationship of 10 kHz (ink ejection frequency) and 80% (duty ratio) is the same as that of 5 kHz and 40%. Similarly, a relationship of 10 kHz (ink ejection frequency) and 40% (duty ratio) is the same as that of 5 kHz and 20% and further, that of 25 kHz and 100%.

A specific device for changing the recording dot size based on the pulse width modulation is a device using, e.g., "Solidstate Scanning Ink Jet Recording with Slit Type Head" disclosed in the Institute of Electronics and Communication Engineers of Japan, '83/1 Vol.J66-C No.1, pp.47–54 (Susumu Ichinose et. al).

Figure 3:
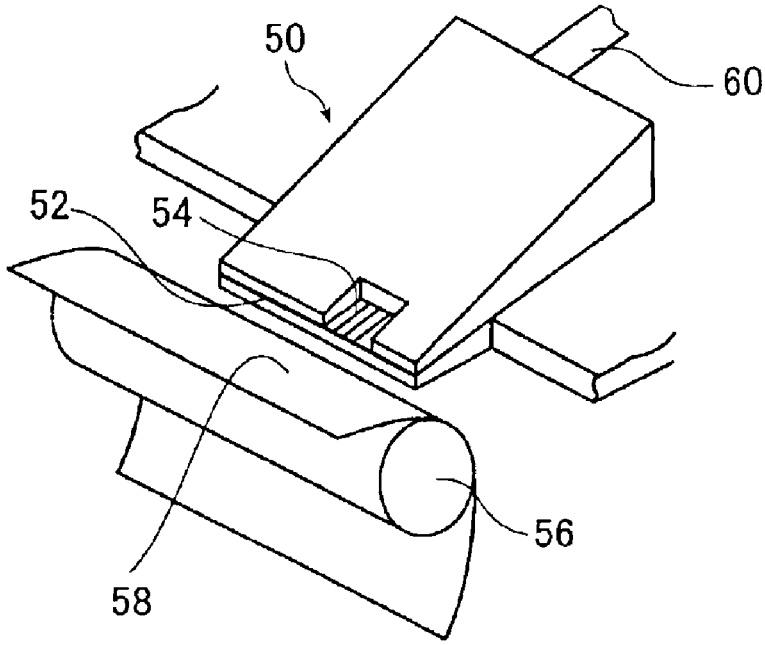
FIG. 3 is a schematic perspective view showing an inkjet head based on a slit jet recording method.

As shown in FIG. 3, the recording head 50 has a slit-shaped ink ejection port 52 formed in a main scanning direction, and recording electrodes are disposed with a predetermined array density along an inner wall of a lower portion of the ink ejection port 52. An opposite electrode 56 is disposed at a minute interval while facing the recording electrodes 54, and recording paper 58 passes through this minute interval therebetween.

The ink ejection port 52 is supplied with the ink via an ink supply path 60. The ink is electrified by applying a voltage to the recording electrodes 54 and to the opposite electrode 56, and when a Coulomb force acting on the ink becomes larger than a surface tension of the ink, the ink is ejected toward the recording paper 58 from the ink ejection port 52. At this time, the recording dot size can be changed by controlling a pulse width of the voltage applied. When the voltage applied to each of the electrodes is fixed, the recording dot size increases with an increase in the pulse width.

As discussed above, the recording dot size can be so controlled as to be changed based on the pulse width modulation, thereby making it possible to prevent the unevenness in image density between the inner peripheral side and the outer peripheral side when performing printing on the surface of the rotating disk 12.

Note that what is disclosed in JP 10-230607 A, etc. may be exemplified as the inkjet recording method capable of the pulse width modulation.

Further, what can be considered as a method of preventing the unevenness in image density between the inner peripheral side and the outer peripheral side of the disk 12, is a method of changing a pitch between arrayed nozzles adjacent to each other in addition to the methods of changing the ink ejection frequency and changing the recording dot size as described above.

More specifically, the degrees of superposition of the recording dots are made uniform as much as possible between the inner peripheral side and the outer peripheral side by setting the pitches between the adjacent nozzles smaller as the nozzle position becomes closer to the outer periphery.

Figure 4:
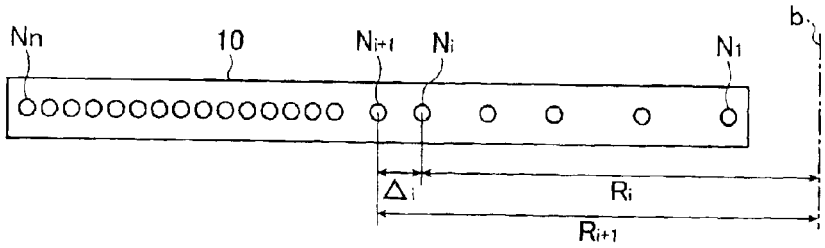
FIG. 4 is an explanatory diagram showing an example in which a nozzle pitch in a nozzle layout is set corresponding to a radius of rotation, of the inkjet head in accordance with the first embodiment of the present invention.

For attaining this, as shown in FIG. 4, assuming that Ri represents a distance from the straight line b defined as the center (the axis of rotations) of (relative) rotations to a nozzle Ni, a pitch Δi between the adjacent nozzles Ni and Ni+1 is calculated from Δi=Ri+1−Ri. The pitch Δi is set substantially inversely proportional to the distance from the center of (relative) rotations.

This is formulated as follows:

$$\Delta i = Ri+1 - Ri = \beta / Ri$$

where β is a predetermined constant. Based on this relationship, the pitch Δi becomes smaller as the distance Ri from the center becomes larger.

Figure 5A:
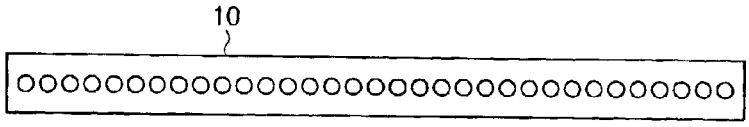
FIGS. 5A, 5B and 5C are explanatory diagrams showing other nozzle layouts of the inkjet head.
Figure 5B:
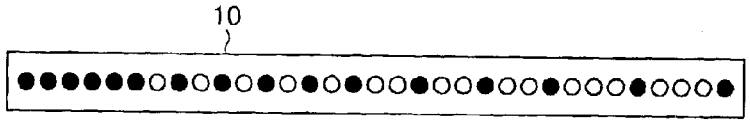

Then, as shown in FIG. 4, the nozzles N1, . . . , Nn are disposed in inverse proportion to the distance from the center of rotations. If the nozzle layout remains fixed in this way, the inkjet head cannot be applied to other types of printing. Therefore, as illustrated in FIG. 5A, the nozzles are equally disposed at fine pitches on the whole. When actually used, as indicated by ● in FIG. 5B, the nozzles may be selectively used corresponding to a recording medium to be used so that the pitches between the adjacent nozzles become gradually smaller from the inner periphery to the outer periphery.

Figure 5C:
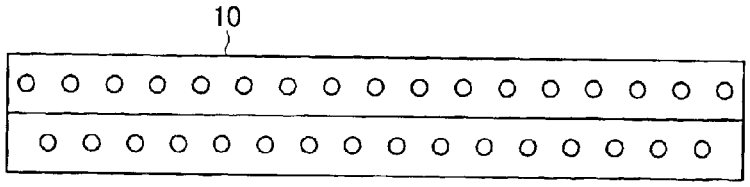

Moreover, the nozzle array is not limited to one line as described above, and, as illustrated in FIG. 5C, the nozzles may be arrayed in a plurality of lines. Then, the nozzle positions in the respective lines deviate from each other, the nozzles are disposed at the finest pitches when using all the nozzles arrayed in two lines, and the nozzles that are used for actually ejecting the inks may be selected from among those nozzles.

An operation in the first embodiment will hereinafter be described with reference to a flowchart in FIG. 6.

To start with, in step S100, data that should be recorded on the surface of the disk 12 is initially expressed on (X, Y) coordinates and is therefore converted into polar coordinates (R, θ) by the inkjet drive control unit 14, which are suitable for recording the data in the circular shape.

In step S110, a page layout of the data that should be recorded on the surface of the disk 12 is analyzed, thereby grasping which position on the surface of the disk 12 the data is recorded in and which data, images or characters, etc. to be recorded.

In step S120, a resolution in the case of performing recording on each recording area is selected based on the page layout grasped in S110. For example, the recording on an image area is conducted with a normal resolution or a low resolution, while the recording is effected on a character area with a high resolution.

In next step S130, the ink ejection frequency at which the ink is ejected from each nozzle is selected (calculated) based on the resolution for every recording area selected in S120 or in consideration of the rotations of the disk 12.

Based on the preparations given above, in step S140, the disk 12 is rotated at the rotational frequency suited to the inkjet recording, and the ink is ejected at the ink ejection frequency determined above, thereby recording the data on the surface of the disk 12.

At this time, as a process in the main scanning direction (the line-array direction), if the recording dots are superposed excessively on the inner peripheral side, the dots are thinned. By contrast, if the recording dots are insufficient on the outer peripheral side, the dots may be interpolated. Alternatively, a fine adjustment of the dot size may also be made by controlling the dot size.

Figure 7A:
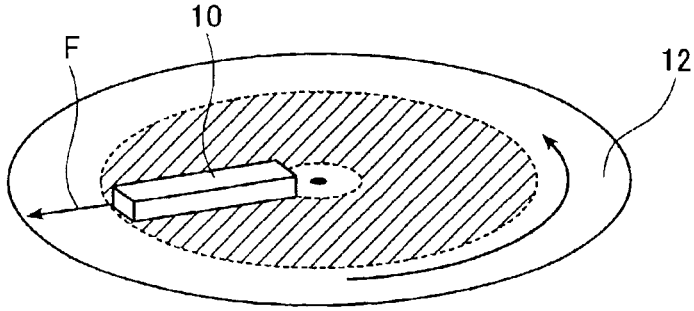
FIG. 7A is an explanatory view of a method of recording on the disk by the inkjet head, showing a case where the inkjet head is smaller than the disk.

Note that the following process may be executed depending on a relationship in size between the disk 12 and the inkjet head 10: as illustrated in FIG. 7A, for example, after performing printing on the inner peripheral side (indicated as a shaded portion in FIG. 7A) of the disk 12 by the inkjet head 10, the inkjet head 10 is moved in a direction of the arrow F (radial direction) in FIG. 7A, and the outer peripheral side of the disk 12 is subjected to printing next.

This printing process involves the use of a mechanism for moving the inkjet head 10 in the radial direction. A preferable system for moving the inkjet head 10 in the radial direction is a self-advancing system, in which the inkjet head 10 is automatically moved after the inkjet drive control unit 14 has detected a termination of printing on the inner peripheral side.

Figure 7B:
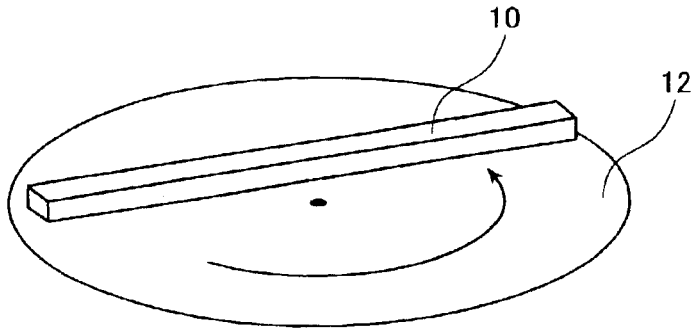
FIG. 7B is an explanatory view of the same method, showing a case where the inkjet head has a size that is approximately the same as a disk diameter.

Further, as shown in FIG. 7B, if the inkjet head 10 has a length approximately equal to the diameter of the disk 12, it is possible to perform printing on the entire surface of the disk 12 simply by rotating the disk 12 through 180 degrees, and this scheme is quite efficient.

Next, a second embodiment of the present invention will be discussed.

Figure 8:
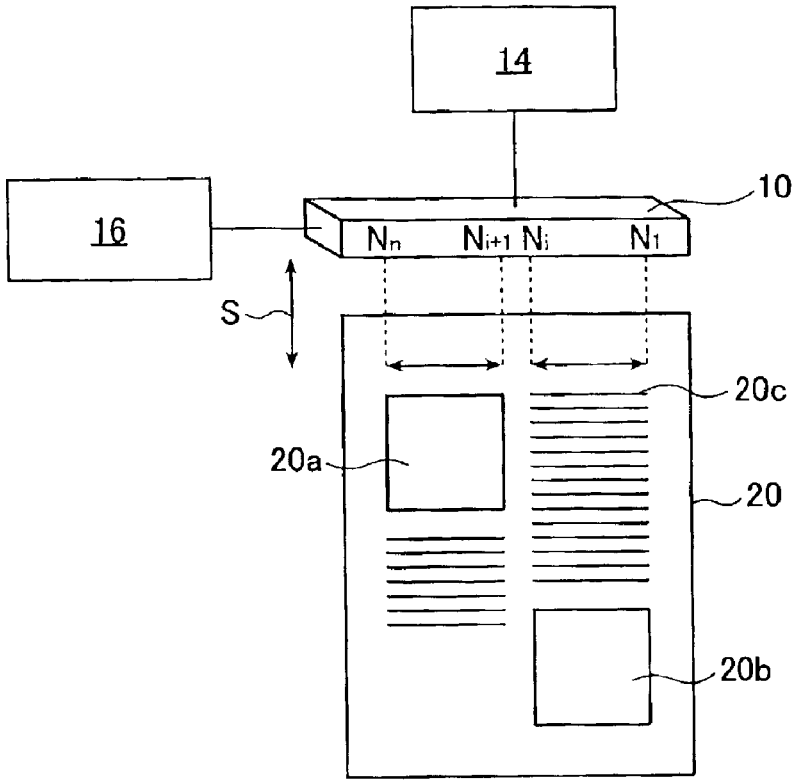
FIG. 8 is a schematic view showing one example of a configuration of the device including the line-array inkjet head in accordance with a second embodiment of the inkjet recording method of the present invention.

FIG. 8 shows a configuration of a device for carrying out an inkjet recording method in accordance with the second embodiment of the present invention.

The second embodiment adopts recording schemes not in the circular shape but in a rectangular shape by relatively moving the inkjet head and the recording medium in an auxiliary scanning direction (indicated by an arrow S in FIG. 8) orthogonal to the line-array direction (the main scanning direction). On this occasion, the recording data contains images, characters, etc., which are recorded with different resolutions, and hence the printing is effected in such a way that the ink ejection frequency changes for each of the recording areas requiring different resolutions.

As illustrated in FIG. 8, according to the second embodiment, it is assumed that the inkjet head 10 has the length approximately equal to one side of rectangular recording paper 20 defined as a recording medium and is disposed above the recording paper 20 in parallel with one side of the recording paper 20.

The inkjet head 10 is controlled in its ink ejection, etc. by the inkjet drive control unit 14. The inkjet head 10 and the recording paper 20 are relatively moved in the auxiliary scanning direction S. This relative movement may be attained, for example, by attaching an auxiliary scanning direction moving mechanism 16 to the inkjet head 10 and moving the inkjet head 10 in the auxiliary scanning direction S, or by moving the recording paper 20 in the auxiliary scanning direction S (opposite to the direction in which the inkjet head 10 is moved) while fixing the inkjet head 10.

The data recorded on the recording paper 20 includes images, illustrations, characters, etc., and the recording paper 20 includes a mixture of areas such as an image area 20*a*, an illustration area 20*b* and a character area 20*c* on which recording is performed with different resolutions.

Thus, it is preferable that the inkjet head 10 has the nozzles that are, as shown in FIG. 5A, for example, arrayed equally at the fine pitches in order to perform simultaneously printing on the plurality of areas with the different resolutions as described above, the inkjet drive control unit 14 appropriately selects the nozzles to be used, changes the pitches between the nozzles, further changes the ink ejection frequency for every nozzle or changes the recording dot size per nozzle, and the recording is thus effected in accordance with the resolution of the recording area.

Figure 6:
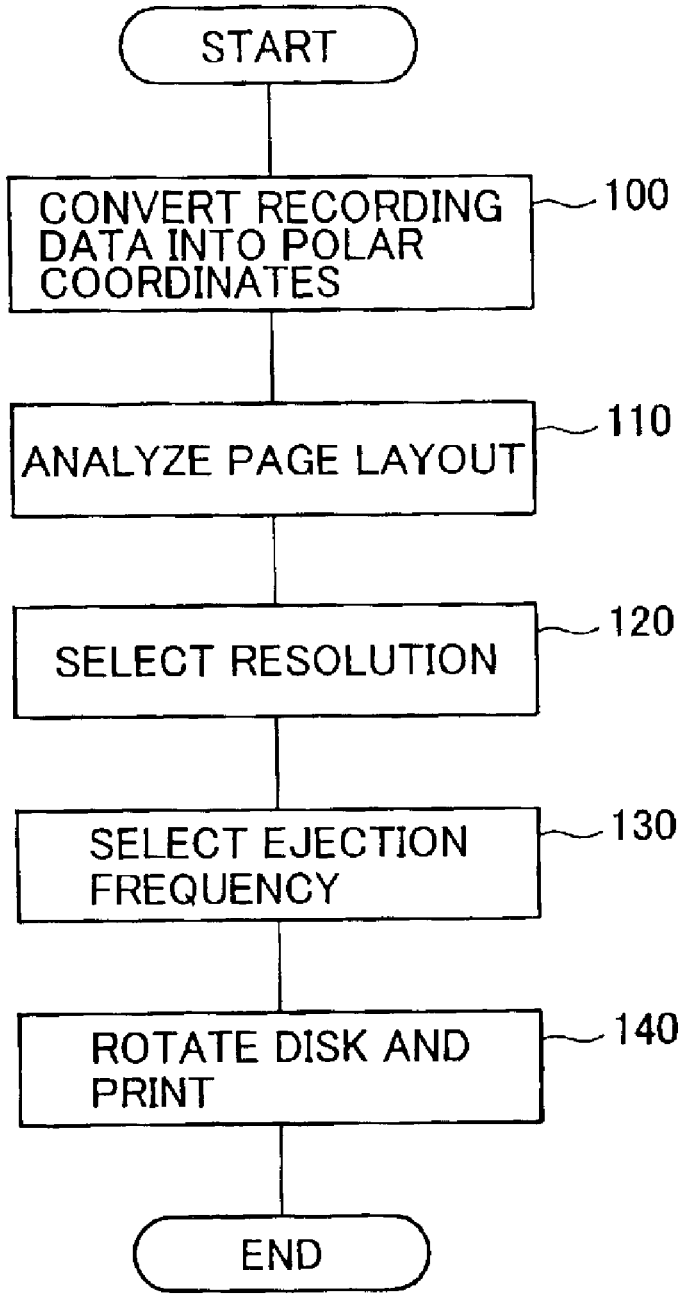
FIG. 6 is a flowchart showing a processing flow of an inkjet recording method in accordance with the first embodiment of the present invention.

An operation in the second embodiment is substantially the same as the operation flow shown in the flowchart in FIG. 6. In the second embodiment, however, recording is not performed in the circular shape and therefore it is unnecessary to convert the recording data into the polar coordinates in step S100.

For instance, in the case of printing an image on the image area 20*a* provided on the upper left side of the recording paper 20 and printing characters on the character area 20*c* provided on the upper right side thereof, the inks are ejected at a high frequency from the right-sided nozzles N1 through Ni of the inkjet head 10 and ejected at a normal frequency from the left-sided nozzles Ni+1 through Nn thereof, thus simultaneously effecting the printing on the areas requiring the different resolutions. This scheme enables the images to be efficiently recorded with no unevenness in image density.

Thus, according to each of the embodiments discussed above, the recording with the high image quality can be performed by restraining the occurrence of unevenness in image density, etc. by the method of changing the ink ejection frequency per nozzle in the case where the ink ejection frequency must be changed between the inner peripheral side and the outer peripheral side of rotations as in the case of printing in the circular shape by rotating the disk, and in the case where the printing is required to be performed with the different resolutions depending on the printing areas even when printing in the rectangular shape, and so forth.

The inkjet recording method of the present invention has been discussed so far in detail, but, the present invention is not confined to the embodiments described above and may be of course modified and changed in various forms without departing from the scope of a gist of the present invention.

As explained above, according to the present invention, in the case of recording in the circular shape on the disk such as a CD or a DVD or in the case of recording on the recording medium including the mixture of the areas such as the image area and the character area on which the recording is preferably effected with the different resolutions, it is possible to perform recording with the high image quality, which causes no unevenness in image density, etc. by changing the ink ejection frequency and the recording dot size in accordance with the respective areas.

What is claimed is:

1. An inkjet recording method using a line-array inkjet head, comprising:

setting ink ejection frequencies different for respective ink ejection holes disposed in array; and ejecting inks onto a plate-shaped recording medium at the different ink ejection frequencies from the ink ejection holes to perform recording, wherein when performing the recording by ejecting the ink from each of the ink ejection holes, a recording dot size differs for each of the ink ejection holes.

2. An inkjet recording method according to claim 1, wherein:

the line-array inkjet head and the recording medium are relatively rotated about a straight line, as an axis of rotation, passing through one point on a straight line extending inclusively of the line-array, which is perpendicular to the recording medium; and the recording is performed by ejecting an ink from each of the ink ejection holes at the ink ejection frequency substantially proportional to a relative peripheral rotating speed in a position of each of the ink ejection holes.

3. An inkjet recording method according to claim 2, wherein the ink ejection frequency at which the ink is ejected from each of the ink ejection holes is changed in accordance with a content of the recording.

4. An inkjet recording method according to claim 1, wherein the ink ejection frequency at which the ink is ejected from each of the ink ejection holes is changed in accordance with a content of the recording.

5. An inkjet recording method according to claim 1, wherein the ink ejection frequency at which the ink is ejected from each of the ink ejection holes is changed in accordance with a content of the recording.

6. An inkjet recording method using a line-array inkjet head, comprising:

setting ink ejection frequencies different for respective ink ejection holes disposed in an array; and ejecting inks onto a plate-shaped recording medium at the different ink ejection frequencies from the ink ejection holes to perform recording, wherein:

the line-array inkjet head and the recording medium are relatively rotated about a straight line, as an axis of rotation, passing through one point on a straight line extending inclusively of the line-array, which is perpendicular to the recording medium, the recording is performed by ejecting an ink from each of the ink ejection holes at the ink ejection frequency substantially proportional to a relative peripheral rotating speed in a position of each of the ink ejection holes, when performing the recording by ejecting the ink from each of the ink ejection holes, a recording dot size differs for each of the ink ejection holes, and the recording dot size is substantially proportional to the relative peripheral rotating speed in the position of each of the ink ejection holes.

7. An inkjet recording method according to claim 6, wherein the ink ejection frequency at which the ink is ejected from each of the ink ejection holes is changed in accordance with a content of the recording.

8. An inkjet printer printing on a recording medium using a line-array inkjet head, comprising:

the ink jet head with a plurality of nozzles disposed in an array;

a plate-shaped recording medium receiving ink drops ejected from said plurality of nozzles; and a controller controlling ejection frequencies for the nozzles, wherein the ejection frequency for said ejection nozzles differ depending on a relative peripheral rotating speed in a position of each of said plurality of ejection nozzles, and wherein when performing the recording by ejecting the ink from each of the ink ejection holes, a recording dot size differs for each of the ink ejection holes.

9. The inkjet printer according to claim 8, wherein the recording dot size is substantially proportional to the relative peripheral rotating speed in the position of each of the ink ejection holes.

10. The inkjet printer according to claim 8, wherein larger dots are produced at outer peripheral portion of the recording medium, and wherein the dot size changes in accordance with the peripheral speed of the recording medium.

11. The inkjet printer according to claim 10, wherein the recording medium is a circular disk rotated at a predetermined rotational frequency.

12. The inkjet printer according to claim 11, wherein the controller selects nozzles from the array of nozzles, to be used for printing, and changes pitches between nozzles.

* * * * *